United States Patent [19]

Schön

[11] Patent Number: 4,541,776

[45] Date of Patent: Sep. 17, 1985

[54] CENTRIFUGAL BLOWER FOR HOT FLUIDS

[76] Inventor: Christian O. Schön, Römerstrasse 1, D-7590 Achern 18, Fed. Rep. of Germany

[21] Appl. No.: 526,918

[22] Filed: Aug. 26, 1983

[30] Foreign Application Priority Data

Sep. 1, 1982 [DE] Fed. Rep. of Germany ..... 3232433
Sep. 25, 1982 [DE] Fed. Rep. of Germany ..... 3235585

[51] Int. Cl.[4] ..... F01D 11/08

[52] U.S. Cl. ..... 415/200; 415/109; 415/134; 415/138; 416/179

[58] Field of Search ..... 415/91, 109, 128, 136, 415/137, 138, 175, 176, 177, 178, 197, 200, 122 A, 214, 89; 416/179, 181, 194, 119

[56] References Cited

U.S. PATENT DOCUMENTS 3,312,389 4/1967 Matsui ..... 415/214
3,778,184 12/1973 Wood ..... 415/136 X
4,083,180 4/1978 Thompson ..... 415/177

FOREIGN PATENT DOCUMENTS 1503607 1/1969 Fed. Rep. of Germany .
7029967 6/1971 Fed. Rep. of Germany .
2361370 6/1975 Fed. Rep. of Germany ..... 415/119
339962 6/1904 France ..... 415/91
2246185 4/1975 France .
867716 5/1961 United Kingdom .

*Primary Examiner*—Robert E. Garrett
*Assistant Examiner*—John Kwon
*Attorney, Agent, or Firm*—Peter K. Kontler

[57] ABSTRACT

A single-stage or multi-stage centrifugal blower for hot fluids has a rotor whose housing is made of steel or carbon filaments and whose vanes are made of a ceramic material. The internal surface of the housing is shielded from hot fluids by a lining which is made of a heat-resistant and heat-insulating material and which shares the angular movements of the rotor. The housing can stand pronounced tensional and bending stresses, and the vanes and the lining are designed to stand the pressure of the conveyed and/or compressed fluid or fluids. The blower can be used as a turbine, a suction fan or a pump and can convey gases whose temperature is in excess of 1600° C. and whose pressure is in the range or in excess of 2000 mm water column.

37 Claims, 22 Drawing Figures

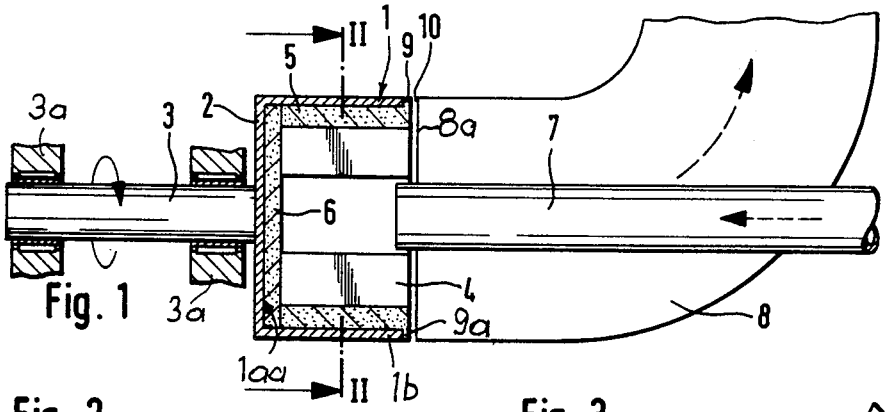
Fig. 1
Fig. 2
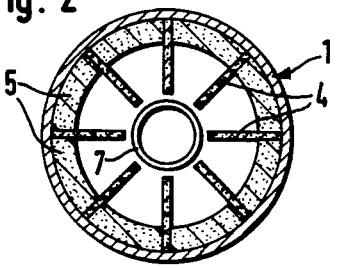
Fig. 3
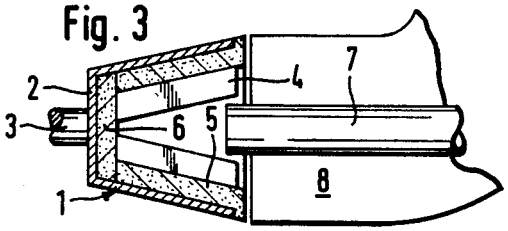
Fig. 4
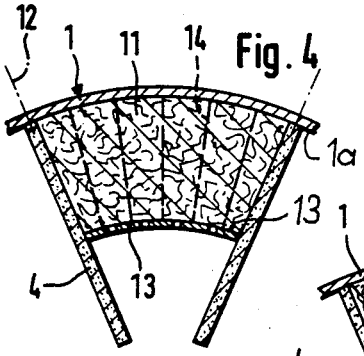
Fig. 6
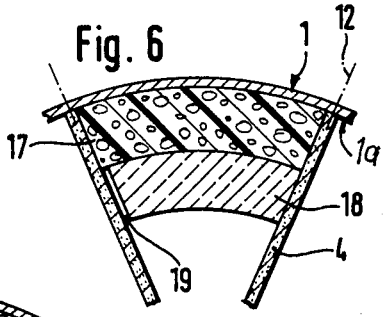
Fig. 5
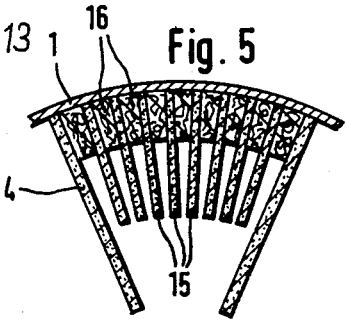
Fig. 7
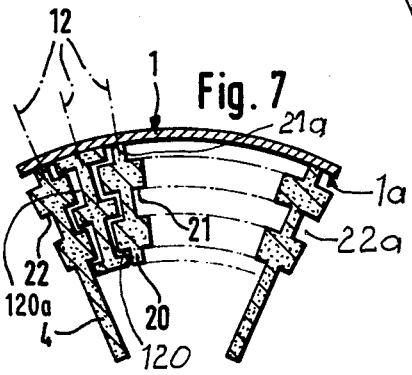
Fig. 8
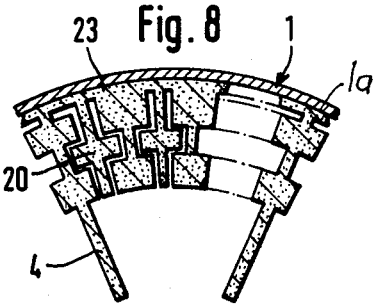

CENTRIFUGAL BLOWER FOR HOT FLUIDS

BACKGROUND OF THE INVENTION

The present invention relates to single-stage or multi-stage centrifugal fluid conveying machines in general, and more particularly to improvements in single-stage or multi-stage blowers or fans for gaseous and/or other fluids which are aggressive because of their elevated temperature and/or for other reasons. Still more particularly, the invention relates to improvements in centrifugal blowers or fans (hereinafter called centrifugal machines) which are designed to normally convey large quantities of gaseous and/or other fluids per unit of time.

It is already known to provide the housing of the rotor of a centrifugal machine with radially inwardly extending vanes which draw a gaseous fluid from a first pipe and deliver the fluid into a second pipe when the rotor is driven by a motor or the like. As a rule, the rotor is a body of rotation and its vanes are made of a material which is capable of standing elevated temperatures and/or the chemical action of a hot and/or otherwise aggressive fluid. For example, German Utility Model No. 7,029,967 discloses a gas turbine which defines a bell-shaped combustion chamber and whose rotor has a hollow housing as well as vanes which extend radially inwardly from the housing. The exterior of the bell-shaped combustion chamber is cooled by air streams. A drawback of such machines is that their output is relatively low if the conveyed fluid is maintained at an elevated temperature and such fluid must undergo at least some or pronounced compression during flow through the machine. The reason is that the resistance which a heat-resistant or chemically resistant material offers to bending and/or tensional stresses decreases very rapidly with increasing temperature of the conveyed fluids, even in response to heating to a relatively low temperature. This applies, for example, to the materials for use in machines that convey very hot gases which are circulated or otherwise conveyed in connection with research involving coal. Thus, if the temperature of such gases rises to approximately 800° C., the stability of the material of heretofore known conveying machines decreases very rapidly so that the RPM of the machines has to be drastically reduced, even if the material of such machines is a high-quality steel. Therefore, a single-stage blower which serves as a means for conveying such gases is incapable of raising the pressure of conveyed gases above 150 mm water column. In fact, such machines are incapable of conveying gases or molten metals whose temperature is in the range of 1200° C., not to speak of temperatures as high as 1600° C. External cooling with streams of atmospheric air cannot furnish the required cooling action when the temperatures rise above 800° C. and approach or exceed 1200° C., especially if the machine is to be operated at a high RPM in order to achieve the requisite throughput and/or compression. While these conventional machines could be operated under the above outlined circumstances by resort to pronounced cooling with streams of air whose temperature is well below room temperature, the cost of cooling would be prohibitive because the energy requirements of the cooling system would render the operation utterly uneconomical.

British Pat. No. 867,716 discloses a gas turbine wherein the material of the vanes and of a ring which surrounds the vanes is a ceramic substance. Such material can stand elevated temperatures; however, it is a good conductor of heat and is incapable of standing even average tensional stresses. Therefore, the turbine of this British patent is provided with an annular plenum chamber which surrounds the aforementioned ring and wherein the pressure of a cooling gas is sufficiently high to partially or completely neutralize the action of centrifugal forces upon the rotor ring and rotor blades. It has been found that the patented turbine presents numerous and serious problems as regards the establishment of seals between stationary and rotating parts and also as concerns the withdrawal of heat from the fluid which fills the plenum chamber. Such heat is transmitted by the ceramic components of the rotor. Withdrawal of heat from the plenum chamber necessitates the provision of a cooling system which is so expensive and whose energy requirements are so high that the patented turbine is utterly uneconomical for a majority of applications. The situation is aggravated if the fluid in the plenum chamber must be maintained at an elevated pressure, i.e., if the action of centrifugal forces upon the ceramic components of the rotor is very pronounced. Consequently, for all practical purposes, the patented turbine is capable of operating only within a relatively low RPM range which is insufficient to allow for adequate compression of certain fluids and/or for conveying of such fluids at the required rate.

All in all, the aforedescribed conventional centrifugal fluid conveying machines and analogous machines are either incapable of conveying very hot and/or otherwise aggressive fluids at the required rate and/or pressure, or are so expensive that they cannot be used under a majority of circumstances.

OBJECTS AND SUMMARY OF THE INVENTION

An object of the invention is to provide a centrifugal fluid conveying machine which can be operated economically in connection with the conveying of fluids whose temperature approaches or even exceeds 1600° C.

Another object of the invention is to provide a fluid conveying machine which can be used to raise the pressure of conveyed fluids to or above 2000 mm water column.

A further object of the invention is to provide a machine which can be operated properly at a relatively low as well as a high or very high RPM of its rotor.

An additional object of the invention is to provide a machine of the above outlined character which can be used for compression and conveying of very hot and/or otherwise aggressive gases at a reasonable cost, which can stand long periods of continuous or discontinuous use, and which can be used for the conveying of a wide variety of gaseous and/or other fluids.

Still another object of the invention is to provide a novel and improved rotor for use in a machine of the above outlined character.

An additional object of the invention is to provide a novel and improved heat insulating system to shield the sensitive parts of the machine from the action of heat and/or other undesirable influences.

Another object of the invention is to provide an insulating system which not only effectively resists the action of heat but is also capable of standing the action of conveyed fluids which are aggressive for any one of a number of other reasons, such as their tendency to react with the material of certain components of the rotor.

A further object of the invention is to provide novel and improved sealing means for use in the above outlined machine.

Another object of the invention is to provide a novel and improved method of shielding certain parts of the rotor housing from the corrosive and/or other influences of hot and/or otherwise aggressive fluids.

The invention is embodied in a single-stage or multistage high-capacity centrifugal fluid conveying machine for aggressive fluids, particularly in a blower for hot gaseous fluids. The machine comprises a rotor having a hollow housing which constitutes a body of rotation and vanes extending substantially radially inwardly from the housing and consisting at least in part of corrosion- and/or heat-resistant material; a lining which is adjacent to the internal surface of the housing, which rotates with the rotor and which consists at least in part of heat-insulating and highly heat-resistant material; means for driving the rotor; first tubular means (e.g., a large-diameter duct) for admitting a fluid into the housing; and second tubular means (e.g., a tubular elbow) for receiving the fluid from the housing. The lining can contain, among others, ceramic fibers, rock wool and similar fibrous substances which are good thermal insulators. The lining can also include loose insulating material (e.g., batches of rock wool or ceramic wool) which is disposed between the vanes of the rotor, and means for limiting the extent of movability of such loose insulating material radially inwardly and away from the internal surface of the housing. The limiting means can constitute or include a sieve-like barrier. The lining can further include a honeycomb with cells extending substantially axially of the rotor. If desired, the machine can further comprise anchoring means (e.g., stay bolts) for securing the lining to the housing and/or for securing the aforementioned limiting means to the housing.

In accordance with one presently preferred embodiment of the invention, the lining includes several groups of rigid or substantially rigid plate-like components which extend substantially radially inwardly of the housing and are assembled into several groups, one group for each space between two neighboring vanes of the rotor. The plate-like components of each group are spaced apart from one another, as considered in the circumferential direction of the rotor, and such lining preferably further comprises fibrous inserts or cushions which are interposed between the components of each group, at least in the regions which are immediately or closely adjacent to the housing.

Those surfaces of the plate-like components in each group which face each other can be provided with recesses and projections so that the adjoining surfaces define labyrinth-shaped channels which extend substantially radially of the housing, i.e., in planes which are normal to the axis of the rotor. Means can be provided to secure such plate-like components to the housing; such securing means can include stay bolts or other types of fasteners. The radially outermost portions of the plate-like components in each group can be integral with one another so that the outermost portion of each group constitutes an arcuate shell which is immediately or closely adjacent to the internal surface of the housing. If desired, both sides of each vane can be provided with recesses and projections, the same as the adjacent surfaces of the adjoining plate-like components, so that the vanes and the adjoining components define additional labyrinth-shaped channels which extend substantially radially of the rotor.

Alternatively, the lining can include an outer layer which is immediately or rather closely adjacent to the internal surface of the housing and consists of a thermally insulating material which is resistant to relatively low temperatures, and an inner layer which is inwardly adjacent to the outer layer and also consists of a thermally insulating material, preferably a material which can stand elevated or very high temperatures. The inner layer can consist of discrete segments which are disposed between pairs of neighboring vanes and each of which defines a clearance with at least one of the respective pairs of vanes. Such clearances can receive deformable inserts or cushions of loose fibrous or other material.

If the housing has an end wall, i.e., if the internal surface of the housing has a section which is disposed in a plane extending substantially at right angles to the axis of the rotor, the lining includes a disc-shaped portion which is adjacent to such section of the internal surface and preferably includes a plurality of neighboring sectors with substantially radially extending gaps therebetween. Such gaps can receive elastic or otherwise deformable inserts and the lining can further comprise sector-shaped covers for the disc-shaped portion, i.e., the disc-shaped portion is then disposed between such covers and the end wall of the housing. The lining can further comprise a second disc-shaped portion which is adjacent to the first mentioned disc-shaped portion in lieu of the covers and has a plurality of neighboring sectors with substantially radially extending gaps therebetween. The gaps between the sectors of one of the disc-shaped portions are preferably offset or staggered with reference to the gaps between the sectors of the other disc-shaped portion, as considered in the circumferential direction of the rotor. The two disc-shaped portions are preferably spaced apart from one another, as considered in the axial direction of the rotor, to define a preferably labyrinth-shaped passage which is preferably narrow and extends substantially radially of the rotor, i.e., in a plane which is or can be substantially normal to the rotor axis. Such labyrinth-shaped passage can be obtained by providing those surfaces of the sectors forming part of one disc-shaped portion which face the other disc-shaped portion with protuberances and by forming the adjoining surfaces of sectors forming part of the other disc-shaped portion with recesses which receive the protuberances with at least some clearance so that the sectors of the two disc-shaped portions are out of contact with one another. Alternatively, the just discussed surfaces of the sectors can be provided with substantially radially extending projections and recesses in the form of ribs and grooves whereby the ribs on the sectors of one of the disc-shaped portions extend with clearance into the grooves of sectors forming part of the other disc-shaped portion and vice versa. It is also possible to provide such surfaces with arcuate ribs and grooves extending circumferentially of the rotor and to assemble the two disc-shaped portions in such a way that the ribs of sectors forming part of one of the disc-shaped portions extend with clearance into the grooves of sectors forming part of the other disc-shaped portion and vice versa.

Irrespective of whether the lining comprises one or more disc-shaped portions, the edge faces of neighboring sectors in one or more disc-shaped portions of the lining can be provided with alternating recesses and projections to define labyrinth-shaped gaps which extend substantially radially of the rotor. The projections on the edge faces of the sectors are out of contact with the neighboring sectors.

The lining can further comprise hollow inserts which extend substantially axially of the rotor and are disposed between the aforementioned section of the internal surface of the rotor and the outermost disc-shaped portion. Such inserts can constitute tubes having a circular or polygonal cross-sectional outline, and the inserts can be made integral with the end wall and/or with the adjacent disc-shaped portion of the lining.

The gap between the open end of the cylindrical portion of the housing and the open end of one of the tubular means can be flanked at one side by a flange which forms part of the lining and extends into the gap along the open end of the housing so that it remains out of contact with the one tubular means. Alternatively or in addition to such flange, the machine can further comprise a labyrinth-type seal which surrounds the open ends of the housing and of the adjacent one tubular means. The latter is normally stationary, and the seal can comprise at least one first annular rib surrounding the open end of the housing and at least one second annular rib which surrounds the open end of the one tubular means. Means can be provided to admit a cool gas (e.g., atmospheric air) into the labyrinth seal. Alternatively or in addition to this feature, the open ends of the housing and of the one tubular means can be provided with blades or vanes which cooperate to force the cool gas between such open ends in response to rotation of the rotor. Alternatively, the labyrinth seal can comprise first and second radially outwardly extending annular flanges which respectively surround the open ends of the housing and the one tubular means. Those surfaces of the flanges which face one another can be provided with alternating substantially concentric rings and grooves. The rings of one flange extend with clearance into the grooves of the other flange, and vice versa. At least some of the rings can include or constitute vanes or blades which serve to force cool atmospheric air into the space between the two open ends in response to rotation of the rotor.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a somewhat schematic fragmentary central longitudinal sectional view of a single-stage centrifugal machine which embodies one form of the invention;

FIG. 2 is a transverse sectional view as seen in the direction of arrows from the line II—II of FIG. 1;

FIG. 3 is a fragmentary central sectional view of a modified machine wherein the major parts of the rotor housing and of the lining therein constitute hollow conical frusta;

FIG. 4 is an enlarged fragmentary transverse sectional view of a machine wherein the portions of the lining between neighboring rotor vanes consist of or include loose insulating material;

FIG. 5 is a similar fragmentary transverse sectional view of a first modification of the structure shown in FIG. 4;

FIG. 6 is a similar fragmentary transverse sectional view of a second modification of the structure shown in FIG. 4;

FIG. 7 is a similar fragmentary transverse sectional view of a third modification of the structure shown in FIG. 4;

FIG. 8 is a similar fragmentary transverse sectional view of a fourth modification of the structure shown in FIG. 4;

DESCRIPTION OF THE PREFERRED EMBODIMENTS

Figure 9:
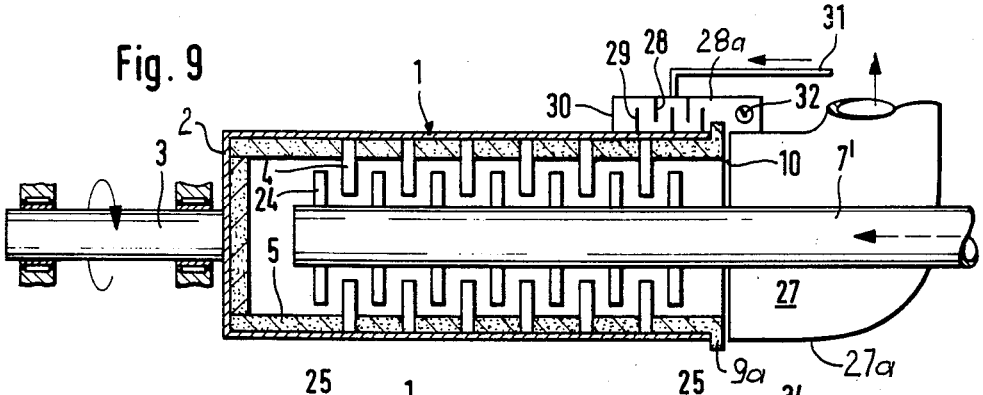
FIG. 9 is a somewhat schematic central longitudinal sectional view of a first multi-stage centrifugal machine.

The single-stage centrifugal fluid conveying machine which is shown in FIGS. 1 and 2 constitutes a blower including a rotor having a cylindrical housing 1 made of sheet steel and including an end wall 2 connected to a stub shaft 3 forming part of a drive means for the rotor. The material of the end wall 2 is or can be identical with that of the cylindrical portion of the rotor housing 1. The manner in which the stub shaft 3 is journalled in suitable bearings **3*a* forms no part of the present invention. The rotor of the blower which is shown in FIGS. 1 and 2 further comprises plate-like vanes 4 which consist of a ceramic material and extend substantially radially inwardly from the internal surface 1*a* of the housing 1. The means for securing the vanes 4 to the housing 1 can comprise threaded bolts or analogous fasteners (not specifically shown) which are embedded into the material of the respective vanes. Those portions of the internal surface 1*a* which are disposed between neighboring vanes 4 are overlapped and shielded from heat and other influences by a lining which consists of a suitable heat-insulating material, e.g., a ceramic material. The lining includes arcuate portions 5 which are inwardly adjacent to the internal surface 1***a* within the confines of the cylindrical portion of the housing 1 and a disc-shaped portion 6 adjacent to that section (1*aa*) of the internal surface of the housing 1 which constitutes the internal surface of the end wall 2. The aforementioned ceramic material is but one of numerous heat insulating substances which can be used for the making of portions 5 and 6 of the lining. The portions 5 and 6 of the lining can be secured to the housing 1 and to its end wall 2 by screws, bolts or other types of fasteners, not shown. It is also possible to resort to a suitable adhesive. The lining shares all angular and other movements of the rotor.

The machine of FIGS. 1 and 2 further comprises a first tubular member 7 which is a straight pipe and is held against rotation with the rotor. The discharge end of the tubular member 7 admits the fluid (e.g., a hot gas) into the interior of the housing 1, namely, into the space which is surrounded by the radially innermost portions of the ceramic vanes 4. The rotating vanes 4 cause such fluid to flow radially outwardly and to enter a second tubular member 8 resembling an elbow and serving to evacuate the fluid from the interior of the housing 1. The tubular member 8 is also held against rotation with the rotor. The directions of fluid flow in the tubular members 7 and 8 are indicated by arrows.

The housing 1 has an open end 1*b* having an edge face 9 which is overlapped by a radially outwardly extending flange 9*a* of the lining. The flange 9*a* and the adjacent open end 8*a* of the tubular member 8 define an annular clearance or gap 10. This flange shields the material of the housing 1 from the action of the hot fluid which flows from the interior of the housing 1 into the tubular member 8. There is no need to provide a special seal for the gap 10 if the machine constitutes a single-stage suction fan serving to circulate a hot and/or aggressive fluid along an endless path. The absence of a seal contributes to simplicity and lower cost of the machine.

The discharge end of the smaller-diameter tubular member 7 terminates at or slightly beyond the right-hand edge faces of the vanes 4. This tubular member can extend through a portion of the elbow-shaped tubular member 8. The diameter of the intake end (8*a*) of the tubular member 8 equals or approximates the diameter of the cylindrical portion of the housing 1. It will be noted that the diameter of the intake end 8*a* of the member 8 can greatly exceed the diameter of the discharge end of the member 7.

The shaft 3 can drive the housing 1 at an RPM which is sufficiently high to achieve a compression of or in excess of 2000 mm water column as well as to circulate large quantities of fluid per unit of time. The temperature of the fluid can be in excess of 1200° C. and even well in excess of 1600° C.

The provision of the improved lining which rotates with the housing of the rotor renders it possible to utilize the machine under circumstances which prohibited the use of heretofore known machines. Moreover, the housing of the rotor can be made of numerous materials which cannot be used in conventional machines of this character. For example, the housing can be made of carbon filaments, i.e., a material which cannot be used in heretofore known machines wherein the basic part of the rotor (namely, the housing which carries the vanes) comes in direct contact with fluids which are maintained at a temperature in the range of 800° and 1600° C. or even higher.

The lining shields the housing from elevated temperatures so that the temperature of the housing is invariably below that at which the housing cannot stand tensional stresses which arise when the pressure of the conveyed fluid medium is in the range or in excess of 2000 mm water column and/or when the RPM of the rotor exceeds a certain value. The improved machine can be used as a blower or as a turbine and its parts are made essentially of three different materials. Thus, the housing 1 of the rotor is made of a material which can stand high or very high tensional stresses (such materials include steel, carbon filaments and others). The vanes 4 are made of a ceramic material which can stand elevated temperatures and compressive stresses but need not stand pronounced tensional, torsional or like stresses. This holds especially true if the vanes are simple plate-like parts. Such vanes are preferably made of a ceramic material. The lining consists of a third material which can stand elevated as well as extremely high temperatures but need not necessarily stand pronounced tensional and/or compressive stresses. The material of the lining can be an amorphous and relatively soft substance. For example, at least a portion of the lining can be made cellular or foamed glass, cellular ceramic material, fibrous insulating material or the like. All that counts is to ensure that the material of the lining can stand the repeated action of centrifugal forces without undergoing excessive and permanent compression and densification.

FIG. 3 illustrates a portion of a second machine wherein the housing 1 comprises a frustoconical portion whose smaller-diameter end is integral with the end wall 2. In all other respects, the machine of FIG. 3 is or can be identical with the machine of FIGS. 1 and 2. For the sake of simplicity, the reference characters which are used in FIG. 3 and denote the aforediscussed parts of the machine (even if the shape and/or size of the parts deviates from the shape and/or size of corresponding parts of the machine of FIGS. 1 and 2) are the same as those employed in FIGS. 1 and 2. The same holds true for the other embodiments of the improved machine.

The arcuate portions 5 of the lining constitute parts of a hollow conical frustum and flank the ceramic vanes 4 of the rotor. The entire lining (including the arcuate portions 5 and the disc-shaped portion 6) rotates with the cupped housing 1.

The machine which employs a frustoconical housing and a lining which defines a frustoconical internal surface for the flow of a fluid toward the open end of the tubular member 8 is especially suited for the conveying and compression of gaseous fluids. Such housing and such lining can be used with advantage in single-stage machines.

FIG. 4 shows a portion of a third centrifugal machine wherein each arcuate portion of the lining comprises a batch of loose insulating material 11, e.g., rock wool. Since the material 11 is loose (i.e., it does not form portions of shells, plates or similar rigid or substantially rigid bodies), it undergoes compression under the action of centrifugal force and bears against the internal surface 1*a* of the cylindrical portion of the housing 1 when the rotor including this housing is in motion. The radially inwardly extending vanes 4 hold the batches of loose insulating material 11 against movement radially inwardly toward the axis of the rotor. In order to ensure that the insulating material 11 cannot leave the spaces between the neighboring vanes 4, the machine of FIG. 4 further comprises a sieve-like barrier 13 constituting a means for limiting the extent of movement of the insulating material 11 away from the internal surface 1*a* of the housing 1. The barrier 13 is secured to the housing 1 by radially extending anchoring elements 14 in the form of stay bolts or the like. Similar or identical anchoring means 12 can be used to secure the vanes 4 to the housing 1. The housing 1 can be made of sheet steel, the same as in the embodiments of FIGS. 1–2 and 3.

The insulating material 11 can also consist of ceramic wool or any other fibrous material which is a good insulator of heat. Moreover, the illustrated loose insulating material can be replaced with Raschig rings or with other types of tower packing. Such rings can be made of a metallic, vitreous or ceramic material and are compacted and condensed and thereby fixed under the action of centrifugal force. Irrespective of its exact composition, such loose insulating material exhibits the advantage that its constituents need not be individually secured to the vanes 4 and/or housing 1 and remain in place (i.e., in the spaces between the neighboring vanes) when the machine is in use because they are urged toward the internal surface 1*a* by centrifugal force as soon as the rotor is set in motion. The sieve 13 or an analogous retaining device merely serves to hold the loose insulating material 11 in place when the machine is idle. Moreover, the loose insulating material 11 holds the vanes 4 in proper positions relative to the housing 1 and thus contributes to stability of the rotor. The stabilizing action of the loose insulating material 11 increases with increasing RPM of the rotor. It is further possible to employ a loose insulating material which is made of very thin sheet metal and constitutes a honeycomb whose cells are closed and extend in parallelism with the axis of the rotor. The gaseous medium (e.g., air) which is entrapped in such cells acts as an insulator and prevents hot gases from reaching the cylindrical or frustoconical portion of the housing 1. It has been found that the insulating action of gases which are entrapped in a honeycomb structure consisting of thin sheet metal or the like is very satisfactory in connection with the conveying and compression of fluids which are maintained at an elevated temperature.

FIG. 5 shows a portion of a centrifugal machine wherein each portion of the lining between a pair of neighboring radially extending ceramic vanes 4 includes a group of plate-like components 15 which can be made of a fibrous or porous ceramic material and extend radially inwardly from the internal surface 1*a* of the housing 1. The neighboring components 15 of each group are spaced apart from one another and from the adjacent vanes 4 to define pockets or clearances for reception of deformable inserts or cushions 16 consisting of a fibrous insulating material. Such cushions need not extend all the way between the radially innermost and radially outermost portions of the adjoining components 15; it normally suffices if the cushions 16 fill those portions of the gaps between neighboring components 15, or between the two outermost components 15 and the respective vanes 4, which are immediately adjacent to the internal surface 1*a*. The material of the cushions 16 can be tamped into the respective gaps. It has been found that the provision of deformable inserts or cushions 16 obviates the need for threaded anchoring means which would permanently or at least fixedly secure the plate-like components 15 to the housing 1.

A presently preferred material for the plate-like components 15 is a cast porous ceramic substance. Tamping of the inserts 16 between the components 15 as well as between the outermost components 15 of each group and the adjacent vanes 4 renders it unnecessary (at least under certain circumstances) to secure the vanes to the housing 1 by resorting to bolts or other types of threaded fasteners. This simplifies the assembly and lowers the initial cost of the machine. Moreover, the unit including the rotating parts 4, 15, 16 within the confines of the housing 1 exhibits a certain elasticity which is highly desirable when the temperatures fluctuate within a wide range, i.e., when the parts which are in contact with the conveyed fluids must undergo pronounced thermally induced expansion or contraction. The omission of bolts or analogous threaded anchoring means for the vanes 4 and/or for the constituents of the lining greatly reduces the manufacturing cost of the machine because the acceptable tolerances are greater if the vanes need not have holes which must register with holes in the housing 1 in order to allow for insertion of bolts, studs or the like.

In the embodiment of FIG. 6, the lining which is adjacent to the cylindrical or frustoconical portion of the internal surface 1*a* includes an outer layer 17 consisting of a first heat-insulating material and an inner layer 18 consisting of a different second insulating material. The ability of the material of the layer 17 to resist elevated temperatures need not be as pronounced as that of the material of the inner layer 18. For example, the layer 17 may consist of a foamed heat insulating material and the material of the inner layer 18 may be the same as that of the plate-like components 15 shown in FIG. 5. The vanes 4 of FIG. 6 are secured to the housing 1 by anchoring means 12 in the form of stay bolts or the like. FIG. 6 further shows that each arcuate portion of the inner layer 18 is spaced apart from one of the neighboring vanes 4 to define therewith a radially extending clearance or gap 19 which allows for thermally induced expansion of the respective portion of the inner layer. If desired, each gap 19 can receive an insert or cushion consisting of a deformable heat insulating material such as rock wool, ceramic wool or the like. The inserts in the gaps 19 can be identical with the inserts or cushions 16 of FIG. 5. In the absence of inserts or cushions, the width of certain gaps 19 is or can be reduced to zero (if the inner layer 18 of the lining is not secured to the outer layer 17) when the machine including the structure of FIG. 6 is brought to a halt. However, all of the gaps 19 are reestablished as soon as the rotor is set in motion because the arcuate portions of the inner layer 18 are then urged radially outwardly toward the inner side of the layer 17 under the action of centrifugal force.

The material of the outer layer 17 can be elastic and the material of the inner layer 18 can be a ceramic substance which abuts against the inner side of the outer layer. The outer layer 17 takes up various stresses and the rigid inner layer 18 can expand when it is contacted by a fluid which is maintained at an elevated temperature.

Referring to FIG. 7, there is shown a portion of a further machine wherein the spaces between pairs of neighboring radially inwardly extending vanes 4 accommodate groups of radially inwardly extending plate-like components 20 each of which is secured to the housing 1 by one or more stay bolts 12 or other suitable anchoring means. Those surfaces of the components 20 which face one another are provided with projections 21 and recesses 21*a*. The recesses 21*a* on a surface of any one of the components 20 receive the projections 21 on the adjacent surface of the adjoining component 20 and vice versa but such components do not actually contact one another. This results in the formation of labyrinth-shaped channels or passages 120 between neighboring components 20.

When the rotor including the housing 1 and the vanes 4 of FIG. 7 is in motion, the relatively heavy cooler fluid is forced to flow into the passages or channels 120 and toward the internal surface 1*a* of the housing, and such cooler fluid expels from the channels 120 the hotter fluid which is compelled to flow toward the axis of the rotor. This shields the housing 1 from contact with hot or very hot fluids.

The plate-like components 20 can be made of a baked porous ceramic material, and the channels or passages 120 allow such components to undergo thermally induced expansion when the machine is in use. In order to further reduce the likelihood of penetration of hot fluids into contact with the internal surface 1*a* of the housing 1, the surfaces of the vanes 4 can be provided with projections 22 and recesses 22*a*. The recesses 22*a* receive, with play, the projections 21 on the adjacent surfaces of the adjoining components 20, and the recesses 21*a* of such components 20 receive the projections 22 of the adjoining vanes 4. This results in the formation of additional labyrinth-shaped channels or passages 120*a*.

The structure which is shown in FIG. 8 is practically identical with that of FIG. 7 except that the radially outermost portions of the components 20 are integral with one another and with the vanes 4 to form a cylindrical shell 23 which is immediately adjacent to the internal surface 1*a* of the housing 1. The radially outermost portions of the plate-like components 20 need not be integral with the adjacent vanes 4, i.e., each group of components 20 can constitute a substantially comb-like unit having an arcuate external shell which fits into the space between the radially outermost portions of two neighboring vanes 4 and a plurality of "prongs" which extend radially inwardly of the shell toward but short of the radially innermost portions of the vanes 4. The structure which is shown in FIG. 8 renders it unnecessary to secure the components 20 individually to the housing 1 or to another part of the rotor.

The linings which are shown in FIGS. 7 and 8 can be used with advantage in large machines. These linings can be made entirely of a ceramic material without risking a breakage in response to thermally induced expansion. This is due to the fact that the channels 120 and 120*a* allow for expansion of the material of the vanes 4 and/or plate-like components 20. Moreover, the labyrinth-shaped channels 120, 120*a* even mcre predictably ensure that the heavier cool fluids remain close to the internal surface 1*a* of the housing 1 and prevent the lighter hot fluids from coming into direct contact with the material of the housing. Also, such stratification of cool and hot gases greatly reduces the likelihood of mixing of cool and hot fluids; mixing is undesirable because it would raise the temperature of that stratum of fluid which comes into direct contact with the housing.

The multi-stage machine of FIG. 9 is similar to the machine of FIGS. 1 and 2. The difference is that the vanes 4 of the rotor are shorter, as considered in the axial direction of the housing 1, and that the tubular member 7' extends axially beyond the innermost vane 4 and close to the end wall 2. This tubular member has stationary guide vanes 24 each of which is disposed in front of a rotary vane 4. The tubular member 27 performs the function of the aforediscussed tubular member 8 and constitutes or resembles an elbow with an open end 27*a* adjacent to the flange 9*a* of the lining. The clearance or gap 10 between the open ends 1*b* and 27*a* is surrounded by a labyrinth seal 30. The latter includes a cylindrical casing 28*a* spacedly surrounding the open ends 1*b*, 27*a*, one or more annular washer-like elements 28 which are secured to the casing 28*a* (one of the elements 28 secures the casing 28*a* to the tubular member 27), and one or more annular washer-like elements 29 which are secured to the housing 1 and alternate with the elements 28. The annular elements 29 and 28 provide an undulate path for flow of a fluid. A conduit 31 serves as a source of a cool gaseous fluid which is admitted into the interior of the labyrinth seal 30 to flow toward and into the gap 10. The cold gas which is supplied by the conduit 31 and fills the undulate path defined by the labyrinth seal 30 prevents escape of hotter fluid which tends to leave the interior of the housing 1 and/or tubular member 27 under the action of centrifugal force and gap pressure. Moreover, the cool gas which is supplied by the conduit 31 reduces the temperature in the region of the open end 1*b* of the housing 1. The reference character 32 denotes a thermometer which can be observed or which can generate signals denoting the temperature in the interior of the labyrinth seal 30. This enables the attendant or an automatic regulating mechanism to adjust the pressure of the fluid which is supplied via conduit 31.

It is also within the purview of the invention to provide the annular elements 29 and/or 28 with short axially extending blades which serve to draw cool atmospheric air into the interior of the labyrinth seal 30. It is further possible to replace the elements 29 and/or 28 with the just discussed blades. The purpose of blades is to raise the pressure of the fluid in the seal 30 so that, under ideal circumstances, the thus induced pressure balances the pressure of fluids which tend to escape through the gap 10.

The multi-stage machine of FIG. 9 can be used with advantage when the fluid which is supplied by the tubular member 7' must undergo pronounced compression on its way toward the intake end of the tubular member 27.

Figure 10:
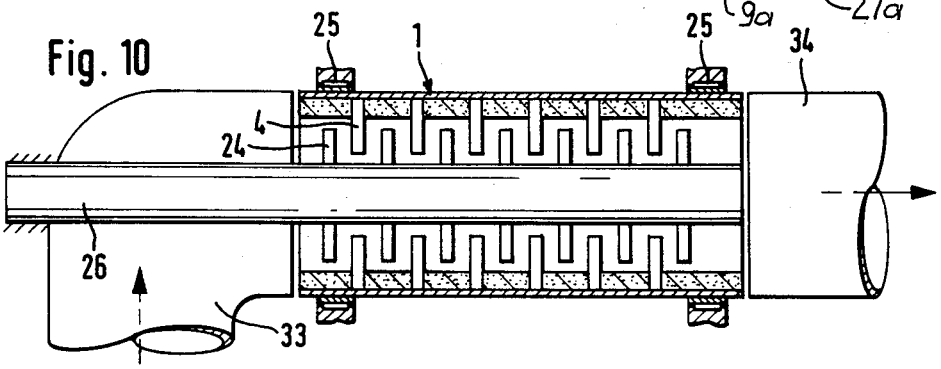
FIG. 10 is a similar sectional view of a second multi-stage machine.

FIG. 10 shows a modified multi-stage machine which constitutes a flow-through compressor and wherein the housing 1 has two open ends one of which is adjacent to the open discharge end of a first tubular member 33 and the other of which is adjacent to the open intake end of a second tubular member 34. The housing 1 is a cylinder which is rotatable in suitable (friction, anti-friction or magnetic) bearings 25. The stationary guide vanes 24 are mounted on a carrier 26 which extends through a portion of the tubular member 33 and is coaxial with the housing 1. The direction of fluid flow through the housing 1 can be reversed, i.e., the tubular member 34 can serve as a means for supplying the fluid and the tubular member 33 then constitutes a means for evacuating compressed fluid from the interior of the housing 1. The means (not specifically shown) for driving the housing 1 and the vanes 4 of the rotor can comprise a V-belt drive, a system of gears, a magnetic clutch or any other suitable means for transmitting torque to the housing 1.

The gaps between the open ends of the housing 1 and the adjacent open ends of the tubular members 33, 34 are preferably surrounded by suitable seals, e.g., by labyrinth seals of the type shown in FIG. 9.

The machine of FIG. 10 is also suitable for effecting pronounced compression of the fluid which is supplied by the tubular member 33 or 34.

Figure 11:
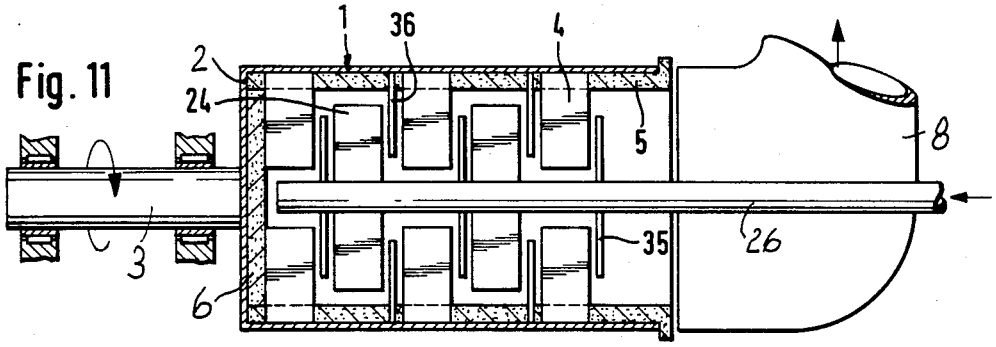
FIG. 11 is a similar sectional view of a third multi-stage machine.

FIG. 11 shows a portion of a unidirectional multi-stage compressor with a rotor including a housing 1 with an end wall 2, a shaft 3 which drives the housing 1 by rotating the end wall 2, several annuli of ceramic vanes 4 which extend radially inwardly from the cylindrical portion of the housing 1, a stationary carrier 26 for guide vanes 24, and deflectors 35 which are also mounted on the carrier 26. The latter constitutes a tubular member which admits a fluid medium into the innermost portion of the housing 1 close to the disc-shaped portion 6 of the lining. The compressed fluid is evacuated by way of the tubular member 8. Each of the stationary deflectors 35 is disposed behind the adjoining vane or vanes 4, as considered in the direction of axial flow of fluid from the discharge end of the carrier 26 toward the open intake end of the tubular member 8. Rotary deflectors 36 are mounted on the housing 1 in front of the respective vanes 4. The deflectors 35 and 36 can be made of sheet metal.

Figure 12:
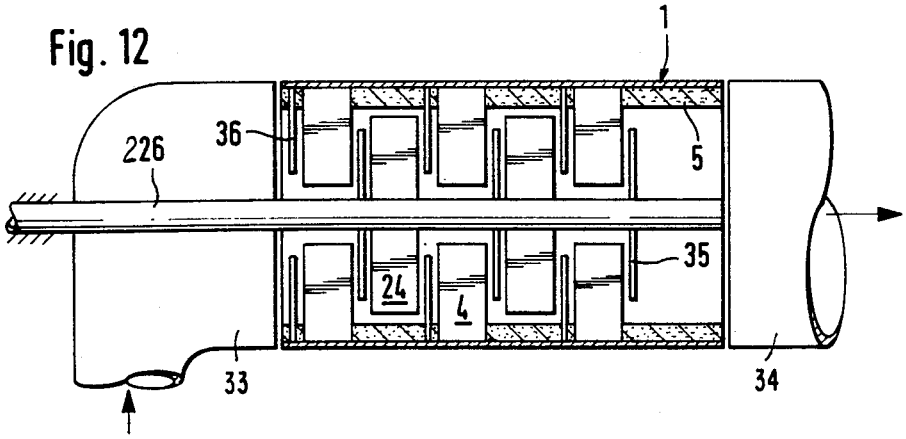
FIG. 12 is a similar sectional view of a fourth multi-stage machine.

The unidirectional multi-stage compressor of FIG. 12 is similar to the compressor of FIG. 11 except that the tubular members 26, 8 are respectively replaced with the tubular members 33, 34. The part 226 is a stationary carrier for the guide vanes 24.

Figure 13:
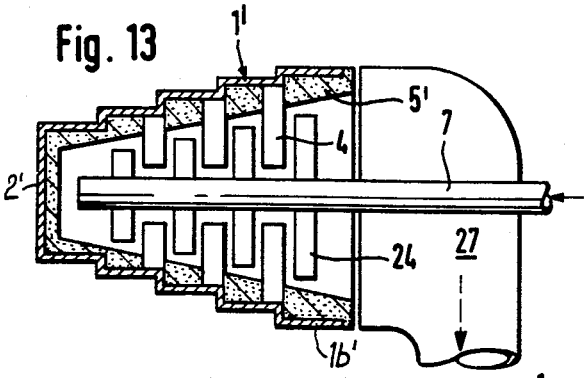
FIG. 13 is a similar sectional view of a fifth multi-stage machine.

FIG. 13 illustrates a further multi-stage compressor wherein the diameter of the housing 1' increases in stepwise fashion in a direction from the end wall 2' toward the open end **1*b*'. Each "step" of the housing 1' carries a vane 4. The insulating lining is configurated in such a way that its major part (annular portions 5') has a smooth frustoconical internal surface along which the fluid flows from the discharge end of the tubular member 7 toward the intake end of the tubular member 27. The tubular member 7 carries stationary guide vanes 24. The annular portions of the lining support the vanes 4, i.e., the vanes need not be bolted or similarly secured to the stepped portion of the housing 1'**. This machine is also particularly suited for the conveying and/or compression of gaseous fluids.

Figure 14:
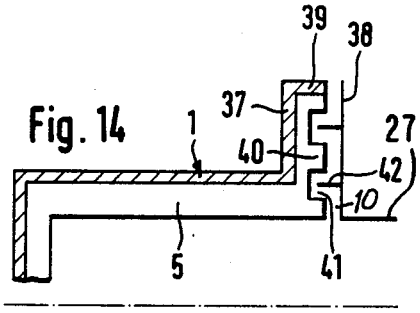
FIG. 14 is a fragmentary central longitudinal sectional view of a further machine with a modified labyrinth seal between the open end of the rotor housing and the open end of the adjacent tubular member.

FIG. 14 shows a portion of a further machine wherein the labyrinth seal for the annular clearance or gap 10 between the housing 1 and the tubular member 27 comprises a first radially outwardly extending flange 37 which is integral with the open end of the housing 1 and a second radially outwardly extending flange 38 which is integral with the open end of the tubular member 27. The flange 37 has an annular outermost portion 39 which extends toward but short of the radially outermost portion of the flange 38, and the flange 37 is further provided with a set of concentric annular protuberances 40 which alternate with concentric annular protuberances 42 of the flange 38. The protuberances 40 alternate with the protuberances 42, as considered in the radial direction of the housing 1, and define therewith an undulate path 41. The protuberances 40 are formed by a radially outwardly extending flange of the lining for the housing 1. Thus, the arcuate portions 5 of the lining extend along that surface of the flange 37 which faces the flange 38 and are provided with arcuate ribs together constituting the aforementioned protuberances 40. These protuberances are out of contact with the protuberances 42 of the stationary flange 38.

The protuberances 40 and/or 42 can be replaced with or can include or constitute relatively short axially extending blades which serve to draw cool atmospheric air into the passage 41 and toward the gap 10 between the housing 1 and the tubular member 27.

Figure 15:
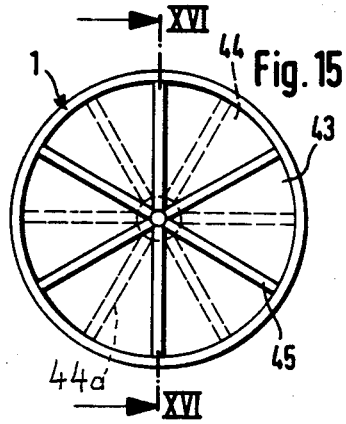
FIG. 15 is a front elevational view of that part of the lining which is adjacent to the end wall of the rotor housing, with the rotor vanes and the remaining portion of the lining omitted.
Figure 16:
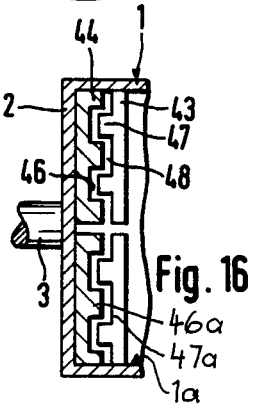
FIG. 16 is a sectional view as seen in the direction of arrows from the line XVI—XVI of FIG. 15.

FIGS. 15 and 16 show that the porous ceramic disc-shaped portion 6 of the lining shown in FIGS. 1 and 2 can be replaced with a disc-shaped portion consisting of a set of, for example, six sector-shaped elements 44 whose neighboring edge faces define relatively narrow radially extending channels or gaps **44*a* . The lining further comprises a second disc-shaped portion consisting of sector-shaped elements 43 which are adjacent to the elements 44 and whose neighboring edge faces define a second set of radially extending channels or gaps 45. The channels 45 are offset with reference to the channels 44*a*, as considered in the circumferential direction of the end wall 2. Those surfaces of the elements 44 which face the adjacent surfaces of the elements 43 are provided with alternating circumferentially extending projections 46*a* and recesses 46. The adjacent surfaces of the elements 43 are provided with alternating projections 47 and recesses 47*a*. The recesses 46 receive with clearance the adjacent projections 47, and the recesses 47*a* receive with clearance the adjacent projections 46*a* so that the two disc-shaped portions including the sector-shaped elements 43 and 44 define a labyrinth-shaped channel or passage 48 extending radially outwardly from the axis of the rotor toward the internal surface 1*a* of the housing 1**.

The number of composite disc-shaped portions can be increased to three or more and the sector-shaped elements of each disc-shaped portion can be secured to the housing 1 by stay bolts or the like. The passage or channel 48 between the two illustrated disc-shaped portions is preferably narrow.

Figure 17:
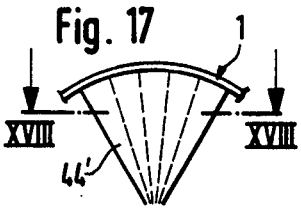
FIG. 17 is a fragmentary front elevational view of one sector of one of two neighboring disc-shaped portions of the lining constituting first modifications of the two disc-shaped portions shown in FIGS. 15 and 16.
Figure 18:
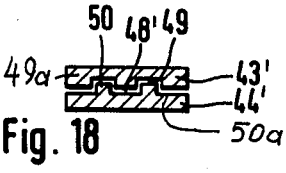
FIG. 18 is a sectional view as seen in the direction of arrows from the line XVIII—XVIII of FIG. 17.

FIGS. 17 and 18 show a modification of the structure which is illustrated in FIGS. 15 and 16. The sector-shaped elements 43' and 44' of the two disc-shaped portions of the lining are provided with alternating radially extending projections and recesses to define a labyrinth-shaped channel or passage 48' which is undulate as considered in the circumferential (rather than in the radial) direction of the end wall (not shown). The recesses and projections of the elements 43' are respectively shown at 49 and **49*a*, and the recesses and projections of the elements 44' are respectively shown at 50*a* and 50**.

Figure 19:
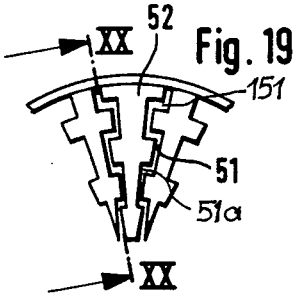
FIG. 19 is a fragmentary front elevational view similar to that of FIG. 15 but showing the sectors of a further disc-shaped portion of the lining.
Figure 20:
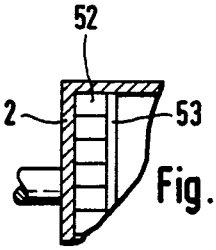
FIG. 20 is a sectional view as seen in the direction of arrows from the line XX—XX of FIG. 19.

FIGS. 19 and 20 show that the neighboring edge faces of sector-shaped elements 52 of a disc-shaped portion of the lining can be provided with alternating protuberances or projections 51 and recesses **51*a*. The recesses 51*a* of each element 52 receive with play the projections 51 of the neighboring elements 52 and vice versa so that such elements define narrow or very narrow radially outwardly extending labyrinth-shaped channels or passages 151. The inner sides of the elements 52 are overlapped by sector-shaped portions of a cover 53 whose portions define radially extending gaps. The portions of the cover are staggered with reference to the elements 52, as considered in the circumferential direction of the end wall 2, to prevent ready penetration of hot fluids into the passages 151**. The provision of various channels, passages and gaps is necessary to allow for thermally induced expansion of component parts of the lining.

The composite cover 53 can be said to constitute a disc-shaped portion of the lining, and the elements 52 can be said to constitute parts of a second disc-shaped portion which is installed between the end wall 2 and the portions of the cover 53. The disc-shaped portion including the sector-shaped elements 52 can be replaced with a loose insulating material such as glass wool, rock wool, ceramic wool or the like. It is also possible to replace the elements 52 with foamed insulating materials such as foamed glass and foamed ceramic substances, as well as with porous ceramic substances. It is also possible to replace the elements 52 with a honeycomb disc-shaped portion. Still further, the elements 52 can be replaced with hollow cylindrical inserts whose axes are parallel to the axis of the rotor, or by hollow tubular inserts having a polygonal or other non-circular cross-sectional outline and extending in parallelism with the axis of the rotor. Such inserts can be made of steel or a heat-insulating material. Each insert can constitute a cell of a honeycomb and confines air or another gas which performs the function of an insulator and reduces the likelihood of penetration of very hot fluids all the way into contact with the end wall 2.

Figure 21:
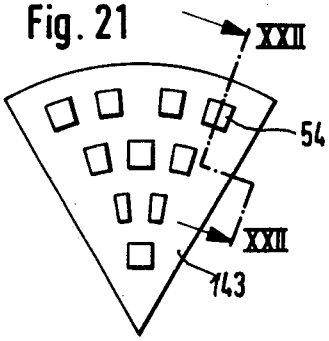
FIG. 21 is a front elevational view of a modified sector.
Figure 22:
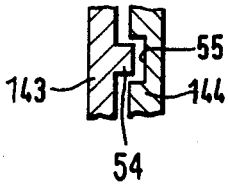
FIG. 22 is a sectional view as seen in the direction of arrows from the line XXII—XXII of FIG. 21.

FIGS. 21 and 22 show a further modification of the structure which is illustrated in FIGS. 15 and 16. One side or surface of each element 143 (only one shown in each of FIGS. 21 and 22) is provided with randomly or regularly distributed square or otherwise configurated staggered protuberances 54 receivable with clearance in recesses 55 provided therefor in the adjacent surface of the neighboring element 144. The projections 54 are preferably small. The disc-shaped portions including the elements 143 and 144 define a labyrinth-shaped channel or passage 148 which reduces the likelihood of ready penetration of hot fluids into the radially extending gaps between neighboring elements 144, namely, those elements which are immediately adjacent to the end wall 2 (not shown in FIGS. 21 and 22).

The provision of radially extending gaps between the sectors of disc-shaped portions which are adjacent to the end wall 2 of the housing 1 is advisable and necessary when the disc-shaped portions are made of a porous ceramic material because such material undergoes more pronounced expansion in response to heating than the material (normally steel) of the housing. In the absence of radially extending gaps, the disc-shaped portions of the lining could break in response to intensive heating because the expansion of the lining would greatly exceed the expansion of the end wall 2 and of the cylindrical portion of the housing 1. It must be borne in mind that the improved lining shields the housing 1 from elevated temperatures so that the expansion of the housing in response to admission of very hot fluids into the space within the lining is nil or is small in comparison with expansion of the disc-shaped portion or portions of the lining.

At least some of the radially extending gaps between the sectors of disc-shaped portions of the lining, and/or the channels or passages between the end wall 2 and the adjacent disc-shaped portion, and/or the channels or passages between neighboring disc-shaped portions can be filled with deformable, e.g., elastic, insulating material such as rock wool to enhance the elasticity of the lining and to ensure that the component parts of the lining are held at an optimum distance from one another.

It will be noted that the heat-insulating action of the lining can be achieved by appropriate selection of the material of which such lining is made and/or by entrapping therein bubbles or larger bodies of a gaseous fluid (e.g., air) which greatly enhances the heat-insulating properties of the lining. Another material which can be used as a highly satisfactory heat insulator is chamotte.

The illustrated gaps, channels and/or passages between the sectors of disc-shaped portions or between the disc-shaped portions of the lining can be replaced with cutouts which need not extend all the way between two neighboring sectors and/or all the way between two neighboring disc-shaped portions. All that counts is to provide room for thermally induced expansion of such parts in response to contact with a fluid which is maintained at an elevated temperature, e.g., a temperature exceeding 1200° C. The cutouts can extend in the radial direction and can be disposed in planes including the axis of the rotor and/or in planes which are normal to such axis.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A high-capacity centrifugal fluid conveying machine, particularly a blower for hot gaseous fluids, comprising:

(a) a rotor including a hollow housing which constitutes a body of rotation, and vanes extending generally radially inwardly from said housing and consisting at least in part of material resistant to aggressive fluids, said housing having an internal surface;

(b) insulating means adjacent to said internal surface and arranged to rotate with said housing, said insulating means including a plurality of plate-like components each of which consists at least in part of heat-insulating and highly heat-resistant material, and each of said plate-like components cooperating with an adjoining plate-like component to define a channel extending generally radially of said housing;

(c) means for driving said rotor;

(d) first tubular means for admitting fluid into said housing; and (e) second tubular means for receiving fluid from said housing.

2. The machine of claim 1, wherein said insulating means includes groups of plate-like components, each of said groups being disposed between a pair of neighboring vanes, and the components of each group having surfaces facing each other and provided with recesses and projections so that such surfaces define labyrinth-shaped channels disposed between the adjoining components of each of said groups and extending substantially radially of said housing.

3. The machine of claim 1, further comprising means for securing said components to said housing.

4. The machine of claim 2, wherein the components of each of said groups have radially outermost portions adjacent to said internal surface and being integral with one another.

5. The machine of claim 2, wherein said vanes have surfaces facing the adjoining components and provided with recesses and projections so that each vane and the adjoining components define additional labyrinth-shaped channels.

6. The machine of claim 1, wherein said housing has an open end and one of said tubular means has an open end adjacent to but out of contact with the open end of said housing; and further comprising a labyrinth seal surrounding said open ends.

7. The machine of claim 6, further comprising means for admitting a cool gas into said labyrinth seal.

8. The machine of claim 7, wherein said open ends are provided with blades which cooperate to force the cool gas between said open ends in response to rotation of said rotor.

9. The machine of claim 6, wherein said labyrinth seal comprises first and second annular flanges respectively surrounding the open ends of said housing and said one tubular means, said first and second flanges respectively having first and second annular surfaces facing each other and provided with alternating substantially concentric annular protuberances and recesses, the protuberances of one of said annular surfaces extending with clearance into the recesses of the other of said annular surfaces and vice versa.

10. The machine of claim 9, wherein at least some of said protuberances include blades arranged to force the surrounding atmospheric air between said open ends in response to rotation of said rotor.

11. A high-capacity centrifugal fluid conveying machine for aggressive fluids, particularly a blower for hot gaseous fluid, comprising a rotor including a hollow housing which constitutes a body of rotation and vanes secured to and extending substantially radially inwardly from said housing and consisting at least in part of material resistant to aggressive fluids, said housing having an internal surface; insulating means adjacent to said internal surface and arranged to rotate with said housing, said insulating means consisting at least in part of heat-insulating and highly heat-resistant material and including loose insulating material disposed between said vanes; means for limiting the extent of movability of such loose insulating material radially inwardly and away from the internal surface of said housing; means for driving said rotor; first tubular means for admitting fluid into said housing; and second tubular means for receiving fluid from said housing.

12. The machine of claim 1, wherein said insulating means contains ceramic fibers.

13. The machine of claim 1, wherein said insulating means contains rock wool.

14. The machine of claim 11, wherein said limiting means comprises a sieve-like barrier.

15. The machine of claim 11, further comprising anchoring means for securing said insulating means to said housing.

16. The machine of claim 11, wherein said insulating means further includes anchoring means for securing said limiting means to said housing.

17. The machine of claim 1, wherein said insulating means includes several groups of plate-like components extending substantially radially inwardly of said housing, each of said groups being disposed between two neighboring vanes, and the components of each group being spaced apart from one another, as considered in the circumferential direction of said rotor, said insulating means further including fibrous inserts interposed between the components of each of said groups at least in close proximity to said internal surface.

18. A high-capacity centrifugal fluid conveying machine for aggressive fluids, particularly a blower for hot gaseous fluids, comprising:

(a) a rotor including a hollow housing which constitutes a body of rotation, and vanes extending substantially radially inwardly from said housing and consisting at least in part of material resistant to aggressive fluids, said housing having an internal surface;

(b) insulating means adjacent to said internal surface and arranged to rotate with said housing, said insulating means consisting at least in part of heat-insulating and highly heat-resistant material, and said insulating means including a honeycomb with cells extending substantially axially of said rotor;

(c) means for driving said rotor;

(d) first tubular means for admitting fluid into said housing; and (e) second tubular means for receiving fluid from said housing.

19. A high-capacity centrifugal fluid conveying machine for aggressive fluids, particularly a blower for hot gaseous fluids, comprising:

(a) a rotor including a hollow housing which constitutes a body of rotation, and vanes extending substantially radially inwardly from said housing and consisting at least in part of material resistant to aggressive fluids, said housing having an internal surface and an open end;

(b) insulating means adjacent to said internal surface and arranged to rotate with said housing, said insulating means consisting at least in part of heat-insulating and highly heat-resistant material;

(c) means for driving said rotor;

(d) first tubular means for admitting fluid into said housing;

(e) second tubular means for receiving fluid from said housing, one of said tubular means having an open end adjacent to but out of contact with the open end of said housing; and (f) a labyrinth seal surrounding said open ends, said one tubular means being stationary, and said labyrinth seal including at least one first annular element surrounding the open end of said housing, and at least one second annular element surrounding the open end of said one tubular means.

20. A high-capacity centrifugal fluid conveying machine for aggressive fluids, particularly a blower for hot gaseous fluids, comprising:

(a) a rotor including a hollow housing which constitutes a body of rotation, and vanes extending substantially radially inwardly from said housing and consisting at least in part of material resistant to aggressive fluids, said housing having an internal surface;

(b) insulating means adjacent to said internal surface and arranged to rotate with said housing, said insulating means consisting at least in part of heat-insulating and highly heat-resistant material, and said insulating means including an outer layer adjacent to said internal surface and consisting of a thermally insulating material which is resistant to relatively low temperatures, and an inner layer inwardly adjacent to said outer layer and consisting of a thermally insulating material which is resistant to elevated temperatures;

(c) means for driving said rotor;

(d) first tubular means for admitting fluid into said housing; and (e) second tubular means for receiving fluid from said housing.

21. The machine of claim 20, wherein said inner layer includes segments disposed between the neighboring vanes and each defining a clearance with at least one of the respective vanes.

22. The machine of claim 21, further comprising readily deformable inserts in said clearances.

23. A high-capacity centrifugal fluid conveying machine for aggressive fluids, particularly a blower for hot gaseous fluids, comprising:

(a) a rotor including a hollow housing which constitutes a body of rotation, and vanes extending substantially radially inwardly from said housing and consisting at least in part of material resistant to aggressive fluids, said housing having an end wall, and an internal surface which comprises a section on said end wall;

(b) insulating means adjacent to said internal surface and arranged to rotate with said housing, said insulating means consisting at least in part of heat-insulating and highly heat-resistant material, and said insulating means including a disc-shaped portion which is located adjacent to said section of said internal surface and comprises a plurality of neighboring sectors with substantially radially extending gaps therebetween;

(c) means for driving said rotor;

(d) first tubular means for admitting fluid into said housing; and (e) second tubular means for receiving fluid from said housing.

24. The machine of claim 23, wherein said insulating means further includes a second disc-shaped portion adjacent to said first named disc-shaped portion and having a plurality of neighboring sectors with substantially radially extending gaps therebetween, the gaps between the sectors of one of said disc-shaped portions being offset with reference to the gaps between the sectors of the other of said disc-shaped portions, as considered in the circumferential direction of said rotor.

25. The machine of claim 24, wherein said disc-shaped portions are slightly spaced apart from one another, as considered in the axial direction of said rotor, and define a labyrinth-shaped passage extending substantially radially toward the axis of said rotor.

26. The machine of claim 25, wherein said disc-shaped portions have surfaces adjacent to said passage, the surface of one of said disc-shaped portions having a plurality of protuberances and the surface of the other of said disc-shaped portions having a recess for each of said protuberances, said protuberances being out of contact with the surface of said other disc-shaped portion.

27. The machine of claim 25, wherein said disc-shaped portions have surfaces adjacent to said passage and provided with substantially radially extending projections and recesses, the projections of the surface of one of said disc-shaped portions extending with clearance into the recesses of the surface of the other of said disc-shaped portions and vice versa.

28. The machine of claim 25, wherein said disc-shaped portions have surfaces adjacent to said passage and provided with alternating projections and recesses extending in the circumferential direction of said rotor, the projections of the surface of one of said disc-shaped portions extending with clearance into the recesses of the surface of the other of said disc-shaped portions and vice versa.

29. The machine of claim 23, wherein the neighboring sectors of said disc-shaped portion have edge faces defining with each other labyrinth-shaped channels extending substantially radially of said rotor, said edge faces having alternating projections and recesses and the projections of the edge face of one sector of each pair of neighboring sectors being received with clearance in the recesses of the edge face of the other of the respective pair of neighboring sectors and vice versa.

30. The machine of claim 23, wherein said insulating means further comprises a cover having sector-shaped portions and overlying said disc-shaped portion, said disc-shaped portion being disposed between said end wall and said cover.

31. The machine of claim 23, further comprising deformable inserts in at least some of said gaps.

32. The machine of claim 23, wherein said insulating means further comprises loose insulating material inserted between said end wall and said disc-shaped portion.

33. The machine of claim 23, wherein said insulating means further comprises a plurality of hollow inserts extending substantially axially of said rotor between said end wall and said disc-shaped portion.

34. The machine of claim 33, wherein at least some of said inserts constitute or resemble hollow cylinders.

35. The machine of claim 33, wherein at least some of said inserts constitute tubes having a polygonal cross-sectional outline.

36. The machine of claim 33, wherein said inserts are integral with said disc-shaped portion.

37. A high-capacity centrifugal fluid conveying machine for aggressive fluids, particularly a blower for hot gaseous fluids, comprising:

(a) a rotor including a hollow housing which constitutes a body of rotation, and vanes extending substantially radially inwardly from said housing and consisting at least in part of material resistant to aggressive fluids, said housing having an internal surface, and said housing further having an open end, and an annular edge face at said open end;

(b) insulating means adjacent to said internal surface and arranged to rotate with said housing, said insulating means consisting at least in part of heat-insulating and highly heat-resistant material, and said insulating means including a flange which is adjacent to said edge face;

(c) means for driving said rotor;

(d) first tubular means for admitting fluid into said housing; and (e) second tubular means for receiving fluid from said housing, one of said tubular means having an open end adjacent to but out of contact with said flange.

* * * * *